US006694108B2

(12) United States Patent
Hirose et al.

(10) Patent No.: US 6,694,108 B2
(45) **Date of Patent: *Feb. 17, 2004**

(54) SYSTEM FOR MANAGING TEMPERATURE IN AN IMAGE FORMING APPARATUS BY CONTROLLING PRINTING SPEED

(75) Inventors: Hiroya Hirose, Sagamihara (JP); Ryo Hanashi, Toride (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/428,456

(22) Filed: Oct. 28, 1999

(65) Prior Publication Data

US 2003/0002881 A1 Jan. 2, 2003

(30) Foreign Application Priority Data

Oct. 30, 1998 (JP) ..... 10-310812

(51) Int. Cl.[7] ..... G03G 15/00
(52) U.S. Cl. ..... 399/44; 399/93
(58) Field of Search ..... 399/94, 44, 97, 399/93, 18

(56) References Cited

U.S. PATENT DOCUMENTS 5,191,362 A 3/1993 Ichikawa ..... 346/160
5,321,481 A * 6/1994 Mathers ..... 399/69
5,448,677 A * 9/1995 Fell et al. ..... 392/383
5,600,406 A * 2/1997 Aikawa et al. ..... 399/70
5,893,009 A * 4/1999 Yamada ..... 399/44
5,907,741 A * 5/1999 Matsuzawa et al. ..... 399/44
6,175,716 B1 * 1/2001 Toyama et al. ..... 399/284

FOREIGN PATENT DOCUMENTS

| | | | |
|---|---|---|---|
| JP | 57-210376 | * | 12/1982 |
| JP | 63-142378 | * | 6/1988 |
| JP | 1-67584 | * | 3/1989 |
| JP | 2-266386 | * | 10/1990 |
| JP | 7-233720 | * | 9/1995 |
| JP | 10-161470 | * | 6/1998 |

* cited by examiner

*Primary Examiner*—Quana M. Grainger
(74) *Attorney, Agent, or Firm*—Fitzpatrick, Cella, Harper & Scinto

(57) ABSTRACT

An image forming apparatus for forming an electrostatic latent image on an electrophotographic photosensitive member, developing the electrostatic latent image and forming a developed image, and transferring the developed image to a recording medium to thereby form an image, the image forming apparatus including, a temperature sensor for detecting temperature in the image forming apparatus, and a controller for controlling a printing speed for forming the image so as to be reduced when the temperature detected by the temperature sensor is a predetermined temperature T1 or higher.

16 Claims, 7 Drawing Sheets

SYSTEM FOR MANAGING TEMPERATURE IN AN IMAGE FORMING APPARATUS BY CONTROLLING PRINTING SPEED

BACKGROUND OF THE INVENTION

1. Filed of the Invention

This invention relates to an image forming apparatus such as a copying machine, a facsimile apparatus or a printer, using an electrophotographic process.

2. Related Background Art

The basic construction of an image forming apparatus is shown in FIG. 8 of the accompanying drawings and the epitome of the operation thereof will hereinafter be described.

An electrostatic latent image bearing member 100 (hereinafter referred to as a photosensitive member) uniformly charged by a primary charger 101 is subjected to exposure 102 by image exposing means (not shown) for making image information into a latent image, whereafter the latent image is developed into a visualized image with toner by a developing unit 103.

A sheet P which is a recording medium is conveyed with its timing taken by registration rollers 104 and 105, and the toner image on the photosensitive member is electrostatically transferred to the sheet P by a transfer charger 106. Thereafter, the toner borne on the recording sheet is fixed by heat and pressure in a fixing unit 108 having a heating roller 109 containing a heat source therein and a pressure roller 110 urged against the heating roller.

Also, after the transfer, some developer untransferred and remaining on the photosensitive member 100 is scraped off by a cleaning unit 111 and is conveyed to a reservoir portion by a waste toner feeding member 112, and charges remaining as the latent image are eliminated by light of an eraser 113.

In the image forming apparatus as described above, various problems arise when the temperature in the apparatus becomes high.

The toner in the developing unit 103 is thermally deteriorated by heat generated from the fixing unit 108 and image density is reduced by a reduction in the charging potential or the waste toner in the cleaning unit 111 is coagulated by heat, and this leads to the trouble of the waste toner feeding member 112.

A fan 46 for exhausting the heat from the apparatus to suppress the temperature rise in the apparatus is disposed in the image forming apparatus so that these problems may not arise.

Also, near the exhaust fan, a filter 48 is disposed to prevent the developer and paper powder from being emitted from the interior of the apparatus.

However, by the long-term use of the apparatus, the toner and paper powder drifting in slight amounts in the apparatus and dust or the like in the air adhere to the filter and are accumulated thereon and as the result, they reduce heat exhausting efficiency and therefore, the inconveniences as previously described due to the temperature rise in the apparatus may be caused.

Against the above-noted problems, there have been proposed a method of detecting the temperature and humidity in the apparatus, and effecting the control of a rotating speed or a capacity of the fan, or effecting such control as changes the area of an opening portion through which heat is exhausted, and a method of installing a plurality of fans at a time and controlling the respective fans.

In the above-described methods, however, plural kinds of sensors and fans and a complicated control mechanism are necessary and the problems of increased cost, bulkiness and noise of the main body of the apparatus are unavoidable.

SUMMARY OF THE INVENTION

It is an object of the present invention to provide an image forming apparatus which has solved the above-noted problems peculiar to the conventional art.

It is another object of the present invention to provide an image forming apparatus which copes with even a temperature rise in the apparatus for a long period.

It is still another object of the present invention to provide an image forming apparatus which copes with even a temperature rise in the apparatus attributable to the clogging of a filter.

The present invention which achieves the above objects proposes an image forming apparatus for forming an electrostatic latent image on an electrophotographic photosensitive member, developing the electrostatic latent image and forming a developed image, and transferring the developed image to a recording medium to thereby form an image, wherein the image forming apparatus comprises: temperature detecting means for detecting temperature in the image forming apparatus; and control means for controlling a printing speed for forming the image so as to be reduced when the temperature detected by the temperature detecting means is a predetermined temperature T1 or higher.

Thereby, even when the filter is clogged by the long-term use thereof and heat exhausting efficiency is reduced, abnormal temperature rise in the apparatus can be prevented without spoiling the lower cost and downsizing of the main body of the apparatus and therefore, it becomes possible to obviate the creation of abnormal images and the trouble of the apparatus.

DESCRIPTION OF THE PREFERRED EMBODIMENTS

First Embodiment

Figure 1:
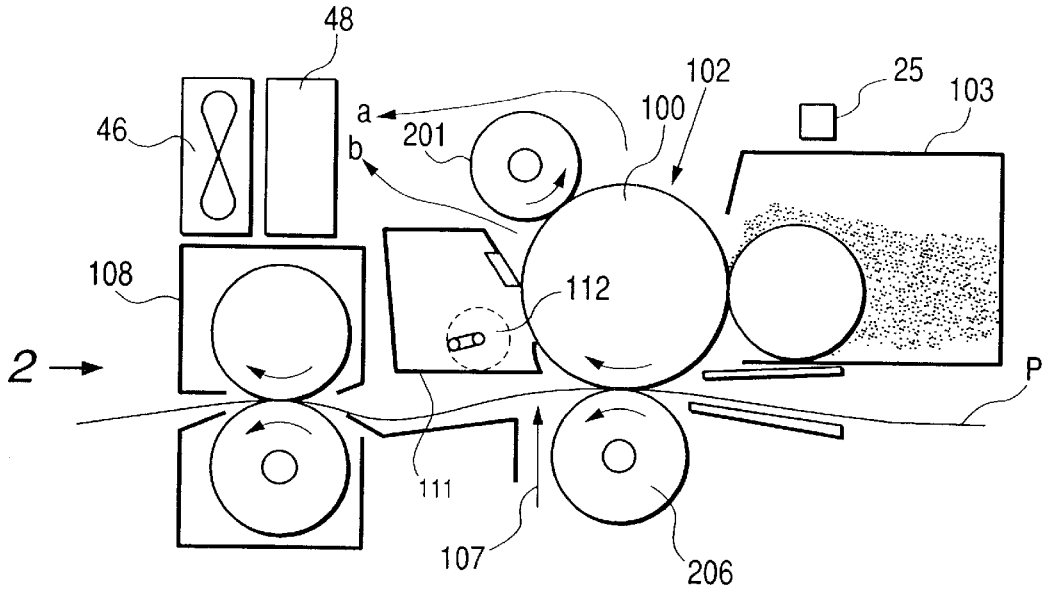
FIG. 1 is a cross-sectional view of a copying machine representing a first embodiment of the present invention.

FIG. 1 represents a cross-section of a copying machine which is an image forming apparatus using a first embodiment of the present invention.

A photosensitive drum 100 uniformly charged by a charging roller 201 is exposed to image information to thereby form an electrostatic latent image, which is then developed with toner by a developing device 103.

By a bias being applied to a transfer roller 206, the toner image on the photosensitive drum 100 is electrostatically transferred to a transfer material P supplied and conveyed to a transfer portion formed by the transfer roller 206 and the photosensitive drum 100.

The transfer material passed through the transfer portion is further conveyed to a fixing device 108, where the transfer material is heated and pressed to thereby fix the toner image on the transfer material.

Any untransferred toner residual on the photosensitive drum is scraped off by a cleaning blade abutting against the photosensitive drum in a cleaner 111 and is stored in the cleaner.

The copying machine in the present embodiment has a process speed of 200 mm/sec. and an image forming speed of 30 sheets/min.

In order to prevent the heat generated in the fixing device 108 from filling the interior of the machine and deteriorating the toner in the developing device and the waste toner in the cleaner to thereby cause bad images to be formed, there is provided a heat exhausting fan 46 driven by a DC bias being applied thereto.

Further, a filter 48 is provided on this side of the heat exhausting fan 46 to prevent a slight amount of toner and paper powder scattering in the interior of the machine from being emitted out of the machine.

Arrows a and b in FIG. 1 represent the typical directions of airflows in the machine created by the rotation of the heat exhausting fan. However, the streams of slight amounts of air exist in various portions such as a gap in the exterior of the apparatus and a gap in sheet supplying and conveying path.

Figure 2:
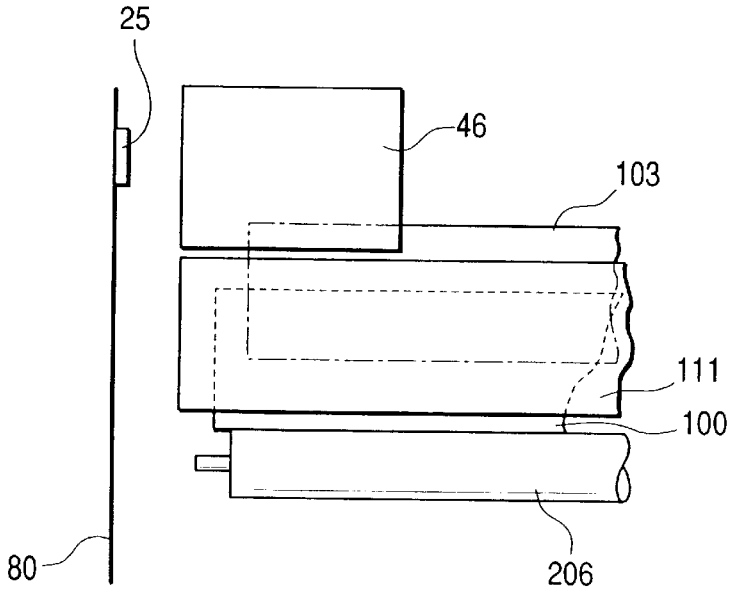
FIG. 2 is a cross-sectional view of the copying machine of FIG. 1 as it is seen from the side 2.

FIG. 2 is a cross-sectional view of the copying machine in the present embodiment as it is seen from the side 2 of FIG. 1.

As shown in FIGS. 1 and 2, a temperature sensor 25 is mounted on the rear side plate of the upper portion of the developing device, and when continuous image formation (hereinafter referred to as the "continuous sheet supply") and image formation at suitable time intervals (hereinafter referred to as the "intermittent sheet supply") were effected, it has been found that in the copying machine in the present embodiment, the detected temperature by the temperature sensor 25 is higher in the continuous sheet supply. It has also been found that in the continuous sheet supply, the detected temperature becomes constant, i.e., reaches a saturated temperature, by the supply of about 1,000 sheets.

Further, the saturated temperature reached by this temperature sensor 25 depends on the number of image forming sheets per unit time, and the smaller is the number of image forming sheets per unit time, the lower is the saturated temperature.

When by the use of the above-described apparatus, the DC bias value applied to the heat exhausting fan was changed and the rotating speed of the fan was set to several kinds to thereby charge the airflow capacity created in the machine and in this state, the continuous sheet supply was effected and the saturated temperature of the sensor 25 was changed, the following bad image was created when the detected temperature by the sensor 25 disposed near the developing device became 40° C. or higher.

When the detected temperature became the above-mentioned temperature, the toner in the developing device was deteriorated and the charging ability of the toner was reduced, whereby a reduction in image density occurred.

However, the bad image as described above is not created on the spot at a point of time whereat the detected temperature by the sensor 25 has reached the saturated temperature, but is created when thermal and mechanical stress is continuously applied to the toner still after the detected temperature has reached the aforementioned temperature.

When in an apparatus wherein the DC bias value applied to the heat exhausting fan is set so that the detected temperature by the temperature sensor 25 disposed in the developing device may not reach 40° C. when the continuous sheet supply is effect at the initial stage of the use of the apparatus, the work of effecting continuous image formation of 1,000 sheets, and stopping it for 5 hours after the detected temperature by the temperature sensor 25 has reached the saturated temperature, and cooling the apparatus to the room temperature, and again effecting continuous image formation of 1,000 sheets (this work is referred to as test cycle 1) was continued, the detected temperature by the temperature sensor 25 exceeded 40° C. at a point of time whereat the number of image forming sheets reached about 100,000 sheets in the aggregate, and a reduction in image density occurred due to the mechanism as described above.

This is because paper powder produced by the sheets conveyed as the transfer materials and the toner scattering in the apparatus were sucked by the fan and adsorbed to the filter 48 and therefore, the filter was clogged and the heat exhausting efficiency by the fan 46 was reduced.

Also, when the test cycle 1 was further continued, the clogging of the filter progressed, and when the use of the apparatus was continued in a state in which the detected temperature by the sensor 25 exceeded 45° C., the coagulation of the toner occurred in the interior of the cleaner and the waste toner conveying member was damaged.

Figure 3:
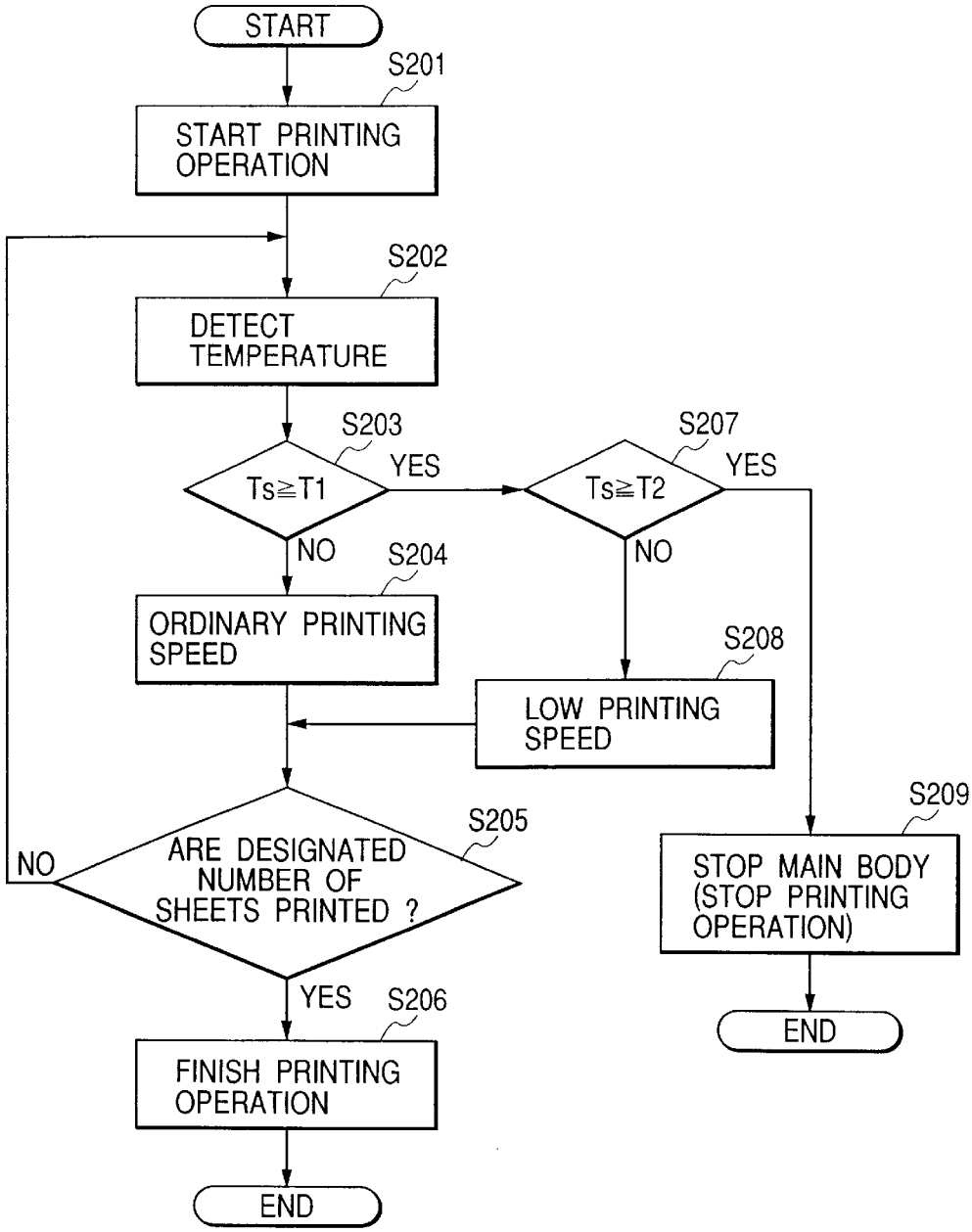
FIG. 3 is a control diagram representing the first embodiment.

So, in the present embodiment, the control as shown in FIG. 3 is provided to prevent the above-noted bad images and trouble of the apparatus.

The detected temperature by the temperature detecting sensor 25 is defined as Ts, and a flow for controlling the printing operation on the basis of Ts will hereinafter be described.

This flow is started by the main switch of the main body of the apparatus being closed and the number of printed sheets being designated by an operating portion (not shown) or the like, and as shown in FIG. 3, the printing operation is started (S201), and temperature detection is started by the temperature sensor 25 (S202). Whether the temperature Ts thus detected by the temperature sensor 25 during the temperature detection is a predetermined temperature T1 or lower is judged (S203). In the present embodiment, 40° C. at which a reduction in image density occurs is set as the temperature T1.

When the temperature Ts detected by the temperature sensor 25 is not the predetermined temperature T1 or higher, the printing operation is performed at an ordinary image forming speed (in the present embodiment, 30 sheets/min.) (S204). Thereafter, whether the designated number of sheets have been printed is judged (S205), and when the designated number of sheets have been printed, the printing operation is finished (S206), and this flow is also ended. On the other hand, when the designated number of sheets have not been printed, return is made to S202.

When at S203, the temperature Ts detected by the temperature sensor 25 is the predetermined temperature T1 or higher, whether this temperature Ts is T2 or higher is judged (S207). This predetermined temperature T2 is a temperature higher than the predetermined temperature T1, and in the present embodiment, the temperature T2 is 45° C. at which the trouble of the feeding member is caused.

When the temperature Ts detected by the temperature sensor 25 is not the predetermined temperature T2 or higher, that is, when the temperature Ts is between the predetermined temperature T1 and the predetermined temperature T2, control is effected so as to reduce the printing speed (S208). In the present embodiment, this reduced printing speed was 20 sheets/min. The specific method of reducing the printing speed will be described later.

Thereby, the printing speed was reduced and the amount of heat generated in the image forming apparatus was reduced and therefore, bad images and the trouble of the apparatus attributable to the temperature reached in the apparatus could be prevented.

When the temperature Ts becomes lower than the predetermined temperature T1 in the middle of the printing operation performed with the printing speed reduced, the printing operation may be performed with the printing speed returned to the ordinary printing speed. Also, in the present embodiment, when the temperature Ts was between the predetermined temperature T1 and the predetermined temperature T2, the printing speed was reduced to a predetermined speed at a stroke, but the printing speed may be continuously reduced on the basis of the temperature Ts, or may be stepwisely reduced.

On the other hand, when the temperature Ts is the predetermined temperature T2 or higher, the operation of the main body of the image forming apparatus is stopped and the printing operation is also stopped to prevent any trouble from occurring to the main body (S209). Thereby, not only the creation of bad images but also the trouble of the main body of the apparatus can be prevented.

A specific example of reducing the printing speed will now be described.

In the ordinary printing operation, images are formed on recording sheets while the recording sheets are continuously conveyed at short intervals (continuous printing operation), but by lengthening the intervals between the recording sheets at this time, the printing speed can be reduced. When the intervals between the continuously conveyed recording sheets are thus lengthened, the number of printed sheets per unit time decreases and the amount of heat required for fixing decreases per unit time.

Even when the printing speed is being reduced, the rotating speed of the fan 46 is constant, and the rotating speed and the airflow capacity are not controlled. Also, design may be made such that a warning for interchanging the filter 48 is given as soon as the printing speed is reduced. The filter 48 is interchanged on the basis of this warning, whereby the continued use of the apparatus becomes possible without the printing operation being stopped.

As described above, the temperature sensor is provided near the drum in the apparatus and the control of the printing speed by the detected temperature is effected, whereby such problems as a reduction in image density and the trouble of the waste toner feeding member could be prevented from arising even when the filter was clogged by the long-term use thereof and the heat exhausting efficiency of the heat exhausting fan was reduced.

Second Embodiment

Figure 4:
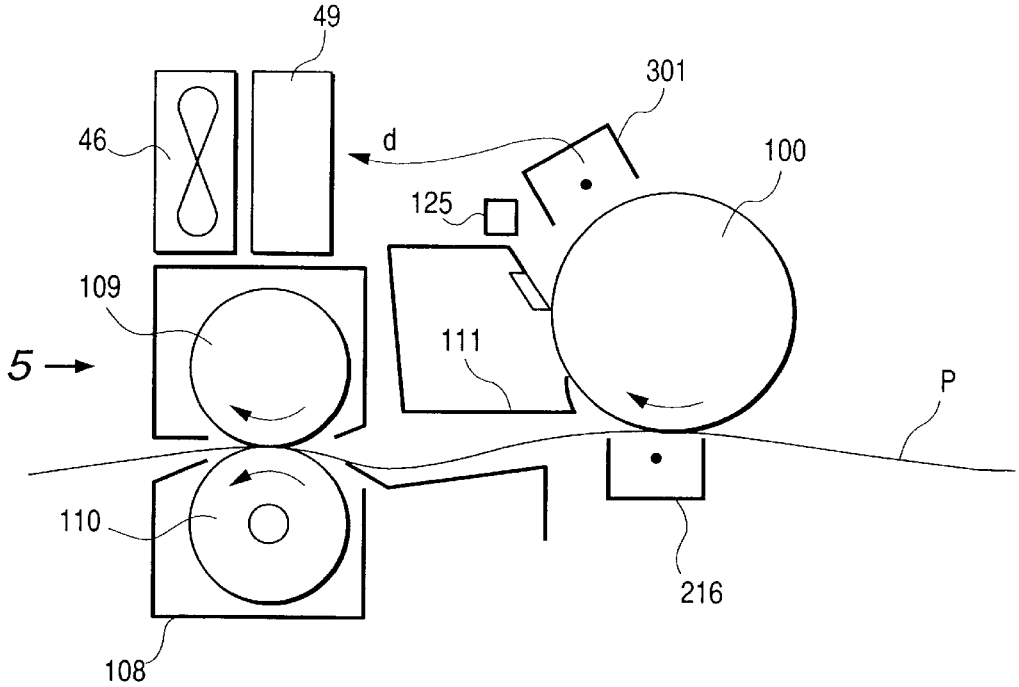
FIG. 4 is a cross-sectional view of a copying machine representing a second embodiment of the present invention.

FIG. 4 is a cross-sectional view of a copying machine representing a second embodiment of the present invention.

Figure 5:
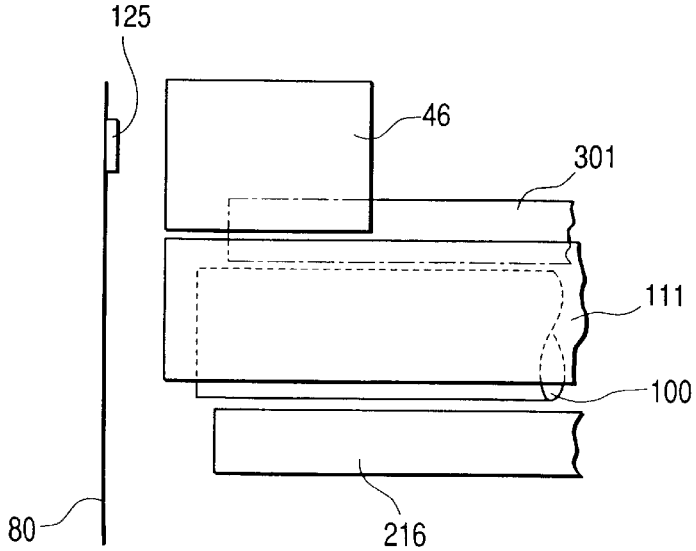
FIG. 5 is a cross-sectional view of the copying machine of FIG. 4 as it is seen from the side 5.

FIG. 5 is a cross-sectional view of the copying machine in the present embodiment as it is seen from the side 5 of FIG. 4.

As shown in FIGS. 4 and 5, a temperature sensor 125 is disposed on a rear side plate 80 near an airflow path d from a corona charger 301 toward a heat exhausting fan 46.

In the present embodiment, the corona charger 301 is used as a primary charger. Also, the copying machine of the present embodiment has a copying speed of 16 sheets/min.

The corona charger effects discharge by applying a high voltage to a metallic wire of a small diameter, and causing a dielectric break down (puncture) of the air near the wire. By ozone produced at that time, substances contained in the air in the machine are oxidized and various kinds of compounds are produced. When these compounds adhere to the surface of the photosensitive member, these compounds absorb humidity in a high humidity environment and the resistance value of the surface of the photosensitive drum is locally reduced and therefore, the problem of image flow arises.

As a countermeasure for it, it is known to form an airflow path d from the vicinity of the primary charger 301 which is the ozone producing portion toward the heat exhausting fan 46, and use an ozone filter 49 comprising a filter disposed on this side of the heat exhausting fan and given the ozone adsorbing ability.

When the test cycle 1 in Embodiment 1 was repetitively effected in an environment of room temperature 30° C. and humidity 80%, the detected temperature by the temperature sensor 125 disposed near the primary charger and the image flow level were as shown in Table 1 below.

Figure 9:
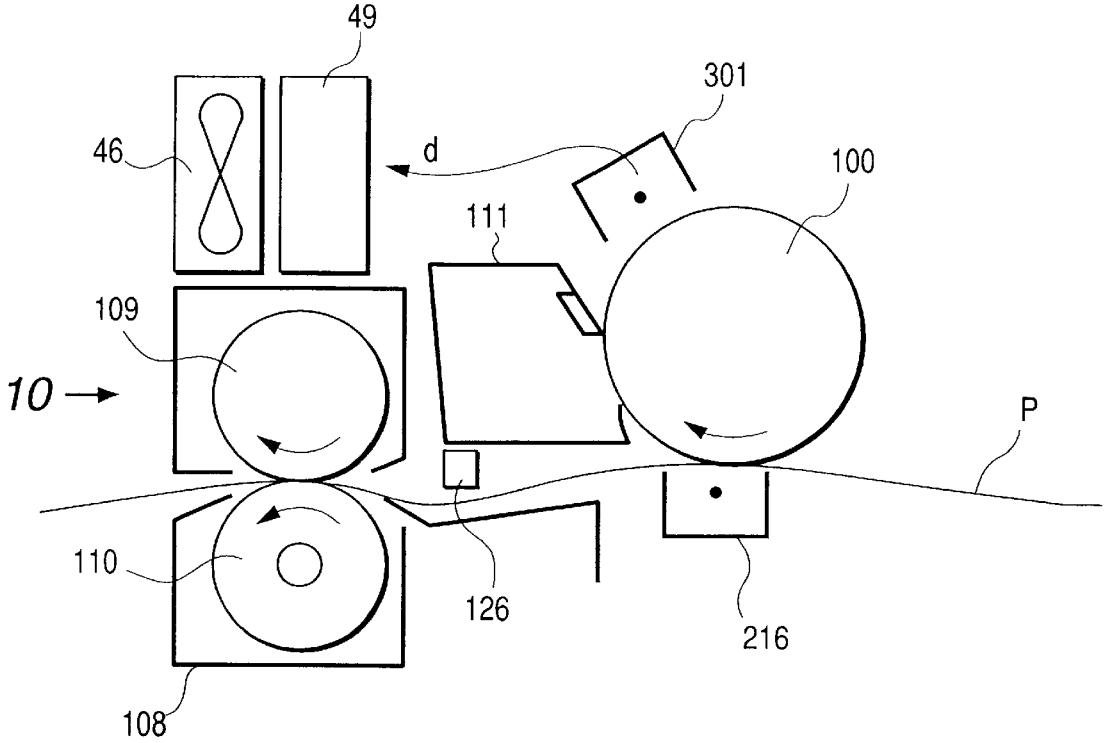
FIG. 9 is a cross-sectional view of a copying machine representing a comparative example of the second embodiment.
Figure 10:
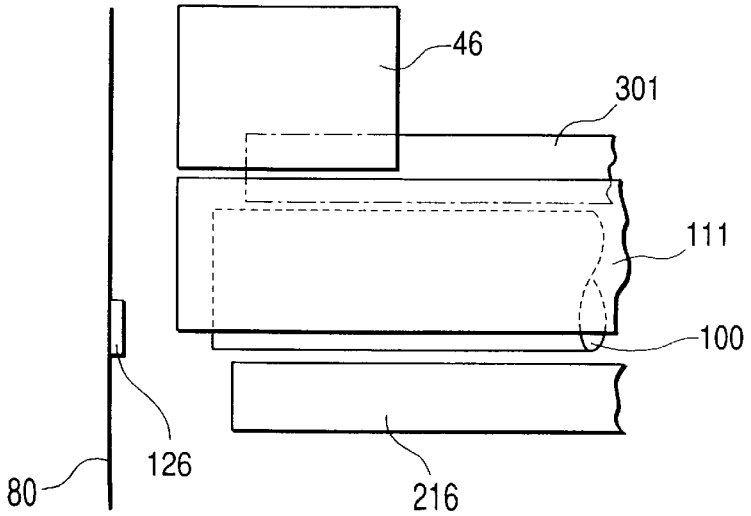
FIG. 10 is a cross-sectional view of the copying machine of FIG. 9 as it is seen from the side 10.

Also, in order to compare with the present embodiment, a temperature sensor 126 was provided on a rear side plate 80 below a cleaner 111 and near a fixing device 108 as shown in FIGS. 9 and 10, and the test cycle 1 in Embodiment 1 was repetitively effected in an environment of room temperature 30° C. and humidity 80%. The detected temperature by the sensor 126 at this time is also shown in Table 1.

TABLE 1

| | 50,000 Sheets | 100,000 Sheets | 150,000 Sheets | 200,000 Sheets |
|---|---|---|---|---|
| Sensor 125 | 38° C. | 39° C. | 42° C. | 45° C. |
| Sensor 126 | 44° C. | 44° C. | 44° C. | 46° C. |
| Image Flow | ○ | ○ | Δ | X |

○: Good
Δ: Medium
X: Bad

The detected temperatures by the sensor 126 have little difference between the durable numbers of sheets and have no correlation with the level of image flow. This is considered to be because the location of the sensor 126 is near the fixing device 108 and the sensor 126 is liable to be directly affected by heat.

On the other hand, the detected temperature by the sensor 125 rises as the double number of sheets increases and is judged to have a correlation with the level of image flow. This is considered to be because the location of the sensor 125 is far from the fixing device and therefore the sensor 125 is hardly subject to the direct influence of heat and is liable to be affected by a reduction in the airflow capacity by the clogging of the filter, and is mounted near the corona charger 301 producing a great deal of ozone and therefore a reduction in the airflow capacity at the location of the sensor 125 exerts an influence upon the level of image flow.

It is seen that when the ozone produced by the corona charger 301 is thus adsorbed by the ozone filter 49, the detected temperature by the temperature sensor 125 disposed on the airflow path near the corona charger rises by the long-term use thereof and the level of image flow is aggravated.

So, in the present embodiment, provision is made of the following control conforming to the detected temperature Ts2 by the sensor 125.

When the detected temperature Ts2 by the sensor 125 is 40° C. or higher, the interval between image forming sheets is extended and the number of copies is reduced from 16 sheets/min. to 8 sheets/min.

It is Table 2 that represents the detected temperature Ts2 by the sensor 125, the level of image flow and the image forming speed (hereinafter referred to as "cpm") when continuous supply of 500 sheets was effected in an apparatus using the above-described control by the use of the apparatus after the supply of about 200,000 sheets and in the apparatus according to the conventional art.

TABLE 2

| Number of Sheets | 0 | 100 | 200 | 250 | 300 | 400 | 500 |
|---|---|---|---|---|---|---|---|
| Example of Conventional Art | | | | | | | |
| Ts2 | 30° C. | 35° C. | 39° C. | 40° C. | 42° C. | 44° C. | 45° C. |
| cpm | | | | 16 | | | |
| Image Flow | ○ | ○ | ○ | ○ | Δ | Δ | x |
| Embodiment 2 | | | | | | | |
| Ts2 | 30° C. | 35° C. | 39° C. | 40° C. | 40° C. | 39° C. | 39° C. |
| cpm | | 16 | | | 8 | | |
| Image Flow | ○ | ○ | ○ | ○ | ○ | ○ | ○ |

○: Good
Δ: Medium
x: Bad

In the apparatus according to the conventional art, the detected temperature Ts2 by the sensor 125 is 40° C. for the supply of about 250 sheets. The image flow in this state is a level free of any problem. However, the detected temperature Ts2 is 42° C. for the supply of about 300 sheets, and in this state, some image flow occurs. When the supply of a greater number of sheets is effected, the detected temperature becomes 45° C. after the supply of 500 sheets, and image flow and abnormal images by the temperature rise occur.

In contrast, in the apparatus having the control in the present embodiment, after the 250th sheet for which the sensor 125 detected 40° C., the copying speed is reduced from 16 sheets/min. to 8 sheets/min. The corona charger has a high voltage applied thereto and produces ozone only when the printing operation is performed and therefore, when the number of copies per unit time is reduced, the amount of heat generated by the fixing device 108 is reduced and the amount of ozone produced by the primary charger 301 is also reduced. Thereby, even after the supply of 300 sheets, the detected temperature is suppressed to 40° C. and image flow does not occur. When the supply of sheets was further continued at a rate of 8 sheets/min., image flow did not occur even after the supply of 500 sheets.

As described above, when the ozone produced by the corona charger was adsorbed by the ozone filter, the number of supplied sheets was controlled based on the detected temperature by the temperature sensor 125 disposed on the airflow path near the corona charger, whereby even when the ozone filter was clogged by the long-term use thereof, the creation of abnormal images by a temperature rise could be prevented and the occurrence of image flow by the ozone could also be prevented.

Third Embodiment

Figure 6:
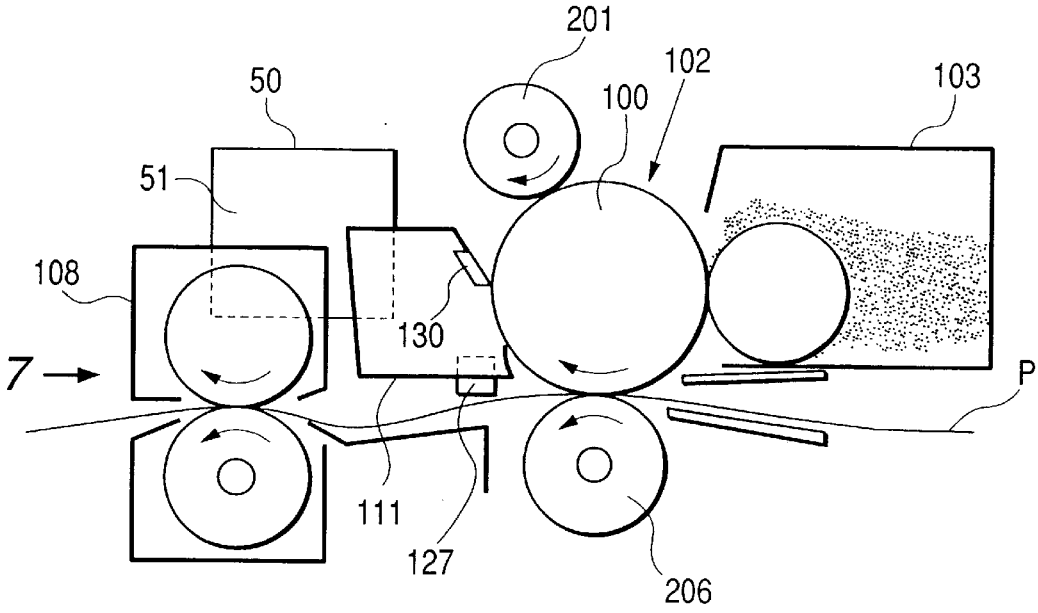
FIG. 6 is a cross-sectional view of a copying machine representing a third embodiment of the present invention.

FIG. 6 is a cross-sectional view of a copying apparatus representing a third embodiment of the present invention.

Figure 7:
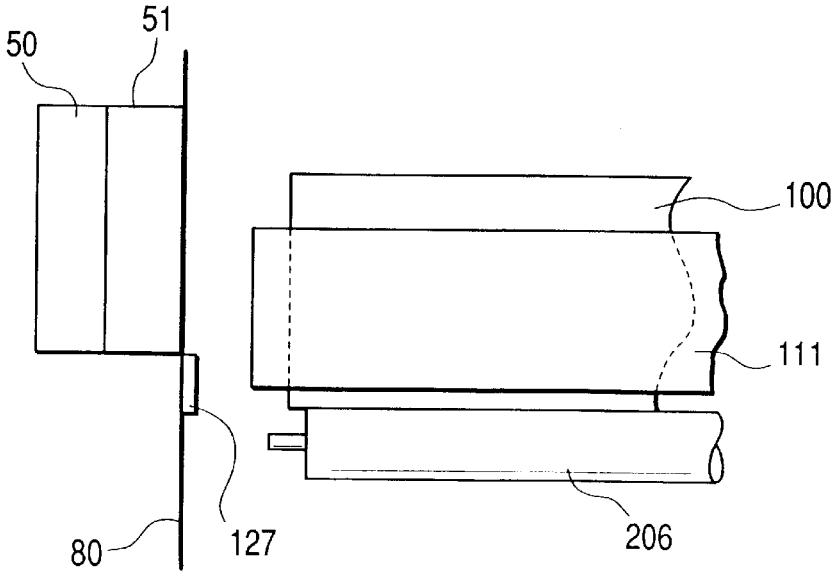
FIG. 7 is a cross-sectional view of the copying machine of FIG. 6 as it is seen from the side 7.
Figure 8:
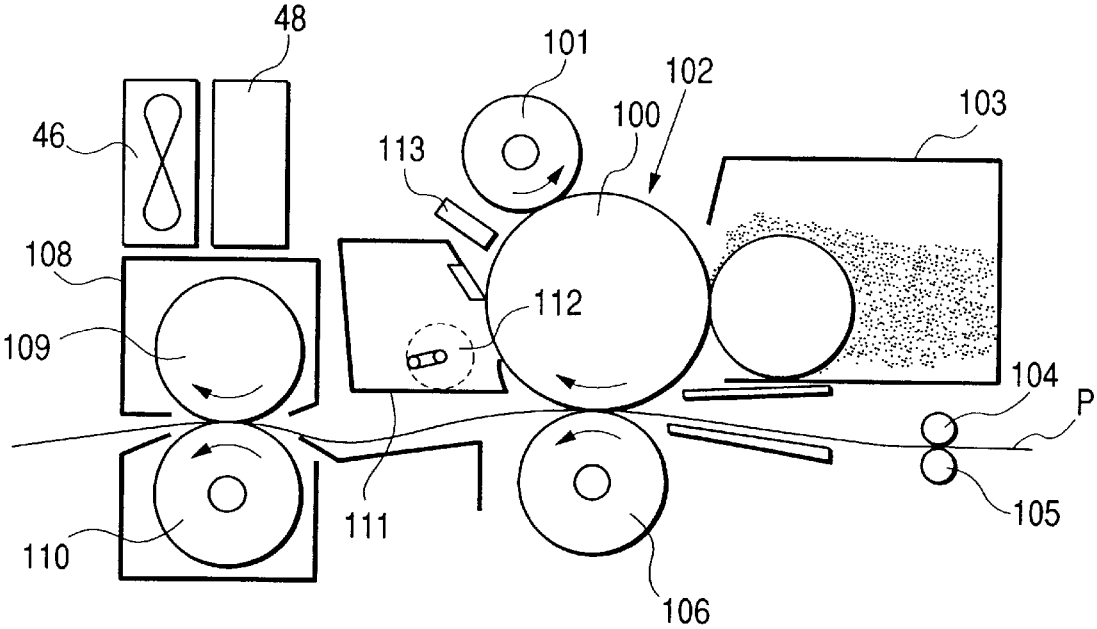
FIG. 8 is a cross-sectional view of a copying machine representing an example of the conventional art.

FIG. 7 is a cross-sectional view of the copying apparatus in the present embodiment as it is seen from the side 7 of FIG. 6.

As shown in FIGS. 6 and 7, there is a heat exhausting fan 50 at a location on the deep side in the longitudinal direction of the main body of the apparatus and astride a cleaner 111 and a fixing device 108, and a filter 51 is disposed near the heat exhausting fan 50. Also, a temperature detecting sensor 127 is provided on the lower portion of the cleaner on a rear side plate 80 and near a drum.

When a transfer material once passed through the fixing device is used and is to be again printed immediately after passed through the fixing device (both-side printing or multi-printing), the transfer material contacts with the drum in the transfer portion in a considerably high temperature state. At that time, heat is transmitted from the transfer material to the drum and therefore, when continuous sheet supply is effected by the use of such transfer materials, the drum assumes a high temperature. The untransferred toner scraped off by a cleaning blade 130 remains in the portion of contact between the cleaning blade 130 and the drum 100 to a certain degree, but this untransferred toner was softened by the temperature rise of the drum and was sometimes fused and bonded on the drum.

When the ordinary printing operation is performed by the use of a transfer material of nearly the same temperature as the room temperature, the cleaner portion receives the heat chiefly from the fixing device from the exterior and therefore, the speed of temperature rise is relatively gentle.

However, when use is made of a transfer material which has once been passed through the fixing device and has therefore assumed a high temperature, the drum receives heat from the transfer material and therefore suddenly and locally rises in temperature and thus, it is necessary to ascertain the temperature rise more quickly.

Figure 11:
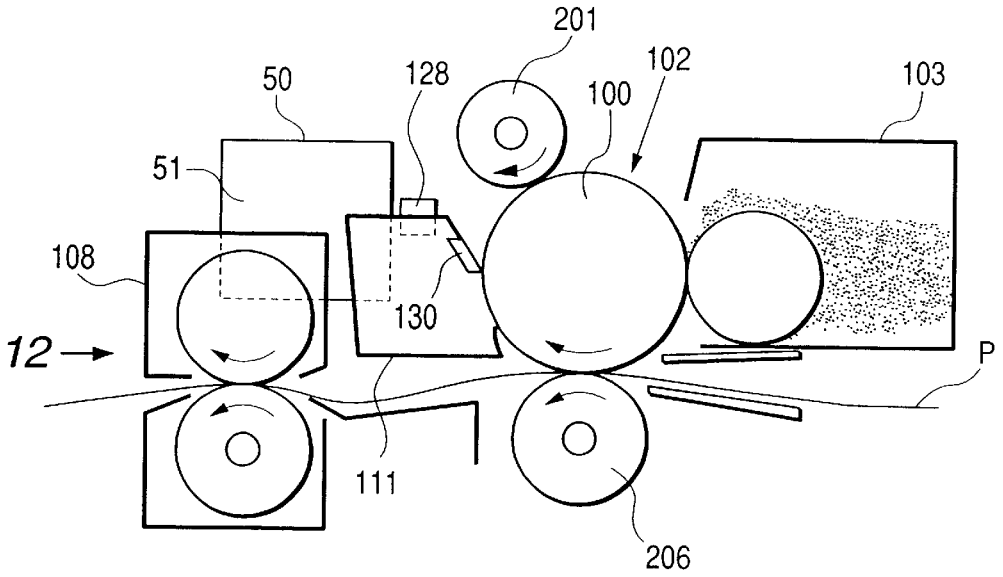
FIG. 11 is a cross-sectional view of a copying machine representing a comparative example of the third embodiment.
Figure 12:
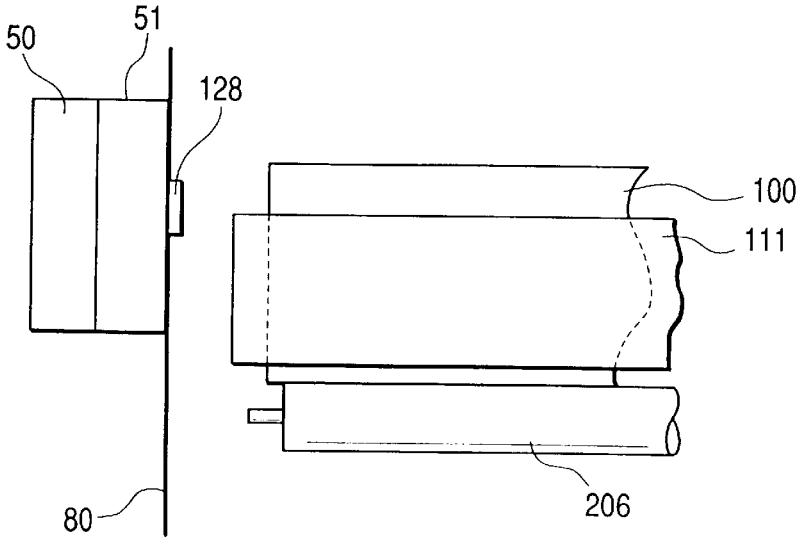
FIG. 12 is a cross-sectional view of the copying machine of FIG. 11 as it is seen from the side 12.

Table 3 below shows the temperature change of the sensor 127 during continuous sheet supply. Also, for comparison, as shown in FIGS. 11 and 12, a sensor 128 was provided on the upper portion of the cleaner on the rear side plate 80 and near the drum so that the amount of heat from the fixing device and the cooling effect of the fan might become substantially equal to those for the temperature sensor 127, and the temperature change during continuous sheet supply was examined. The result is also shown in Table 3.

TABLE 3

| | | 0 Sheet | 500 Sheets |
|---|---|---|---|
| Sensor 127 | Single Side | 37° C. | 38° C. |
| | Both-Side | | 44° C. |
| Sensor 128 | Single Side | 37° C. | 38° C. |
| | Both-Side | | 40° C. |

In Table 3, the "single side" refers to a case where image formation was effected by the use of transfer material which have never been passed through the fixing device, and the "both-side" refers to a case where use was made of transfer materials immediately after passed through the fixing device.

The filter of the heat exhausting fan was a new one.

Immediately after the continuous supply of 100 single side sheets, continuous image formation on 500 sheets was effected for each of both-side and single side.

In Table 3 the temperature for 0 sheet is that immediately after continuous image formation on 100 sheets was effected. Since there is no influence of the transfer materials upon the temperature, there is no difference in detected temperature between the sensors 127 and 128. Likewise, in the supply of 500 single side sheets, there is seen no difference between the detected temperatures by the sensors.

On the other hand, when 500 both-side sheets were supplied, the sensor 127 detected 44° C. and the sensor 128 detected 40° C. It will thus be seen that the influence of the heat of the transfer materials can be more sensitively detected by the sensor 127 disposed near the portion of contact between the transfer material and the drum than by the sensor 128.

Therefore, in the present embodiment, the image forming speed was controlled in conformity with the detected temperature Ts3 by the temperature detecting sensor 127 provided on the lower portion of the cleaner on the rear side plate 80 and near the drum.

For comparison, the following experiment was carried out in an apparatus wherein the control of the image forming speed conforming to the detected temperature Ts3 by the sensor 127 in the present embodiment is not effected. It is Table 4 that shows the detected temperatures by the sensors 127 and 128 and the result of the fusion bond of the toner occurring on the drum when 200,000 sheets were installed in the apparatus and by the use of a durable filter, continuous both-side image formation on 500 sheets was effected immediately after the continuous supply of 100 single side sheets.

TABLE 4

| | 0 Sheet | 300 Sheets | 400 Sheets | 500 Sheets |
|---|---|---|---|---|
| Sensor 127 | 38° C. | 44° C. | 47° C. | 49° C. |
| Sensor 128 | 38° C. | 42° C. | 42° C. | 43° C. |
| Drum Fusion Bond | ○ | ○ | Δ | X |

○: Good
Δ: Medium
X: Bad

For the supply of 400 sheets, minute drum fusion bond occurred due to a temperature rise, and for the supply of 500 sheets, fusion bond at an unallowable level occurred.

From this result, in order that fusion bond may not occur, when the sensor 127 detects 45° C. or when the sensor 128 detects 40° C., it is necessary to reduce the image forming speed to thereby reduce the amount of heat transmitted from the transfer materials to the drum per unit time.

So, Table 5 below represents the timing at which the copy speed reduction temperature when the continuous supply of 500 both-side sheets was effected ten times by the use of apparatus 1 and apparatus 2 in which the control of the image forming speed conforming to the detected temperatures by the sensors 127 and 128 was set as follows was detected, and the number of times by which fusion bond occurred at the end of the supply of 500 sheets.

TABLE 5

| | Copy Speed Reduction Timing 10 Times Average (Discrepancy) | Fusion Bond Occurrence Number |
|---|---|---|
| Apparatus 1 (Sensor 127) | 330 Sheets (±30 Sheets) | No Time |
| Apparatus 2 (Sensor 128) | 250 Sheets (±60 Sheets) | Two Times |

Apparatus 1: When the sensor 127 detects 45° C., the copy speed is reduced from 30 sheets/min. to 15 sheets/min.
Apparatus 2: When the sensor 128 detects 40° C., the copy speed is reduced from 30 sheets/min. to 5 sheets/min.

In apparatus 1, the copy speed is reduced after the supply of about 300 sheets, but fusion bond did not occur. On the other hand, in apparatus 2, the copy speed is reduced after the supply of 190 sheets at earliest. Also, fusion bond occurred two times.

As described above, in the apparatus which can again print transfer materials once passed through the fixing device, without particularly making a user instruct the apparatus to use such transfer materials or without detecting the fact of being such transfer materials by the use of a complicated sensor or control, a temperature sensor in the apparatus like the sensor 127 is disposed near the drum in the lower portion of the cleaner and the image forming speed is controlled by the detected temperature thereby, whereby the occurrence of fusion bond could be suppressed without reducing the productivity of image formation to the utmost.

According to the above-described embodiment, a temperature sensor is provided near the drum and the control of the printing speed based on the detected temperature thereby is effected, whereby even when the filter was clogged by the long-term use thereof and the heat exhausting efficiency of the heat exhausting fan was reduced, such problems as a reduction in image density and the trouble of the waste toner feeding member could be prevented from arising.

Also, in an apparatus wherein ozone produced by the corona charger is adsorbed by an ozone filter, a temperature sensor is disposed on the airflow path near the corona charger and the number of supplied sheets is controlled based on the detected temperature by the temperature sensor, whereby even when the ozone filter was clogged by the long-term use thereof, the creation of abnormal images by a temperature rise could be prevented and the occurrence of image flow by the ozone could also be prevented.

Further, in an apparatus which can again print transfer materials once passed through the fixing device, without particularly making the user instruct the apparatus to use such transfer materials or without detecting the fact of being such transfer materials by the use of a complicated sensor or control, a temperature sensor is disposed near the drum in the lower portion of the cleaner and the image forming speed is controlled based on the detected temperature thereby, whereby the occurrence of fusion bond could be suppressed without reducing the productivity of image formation to the utmost.

What is claimed is:

1. An image forming apparatus comprising:

an electrophotographic photosensitive member;

charging means for imparting predetermined potential to said electrophotographic photosensitive member;

exposure means for forming an electrostatic latent image on said electrophotographic photosensitive member;

developing means for developing the electrostatic latent image with toner;

transferring means for transferring a developed toner image to a transfer material;

fixing means for fixing the toner image on the transfer material;

exhausting means for effecting an exhaust of heat in said image forming apparatus;

a filter provided in proximity to said exhausting means for filtering exhaust from said exhausting means; and a temperature sensor at a predetermined location near said electrophotographic photosensitive member, wherein when a temperature detected by said temperature sensor is Ts, and when relative to predetermined temperatures T1 and T2, $$T2 > Ts \geqq T1,$$

a number of image forming sheets per unit time is decreased, and when $$Ts \geqq T2,$$

an image forming operation is stopped.

2. An image forming apparatus according to claim 1, wherein said temperature sensor is disposed at a location along an airflow path formed from the charging means to said exhausting means.

3. An image forming apparatus according to claim 1, wherein said temperature sensor is disposed on a lower portion of cleaning means of said image forming apparatus and near the photosensitive member.

4. An image forming apparatus for forming an image on a recording medium, comprising:

an electrophotographic photosensitive member;

developing means for supplying a developer to an electrostatic latent image formed on said electrophotographic photosensitive member to thereby form a developed image thereon;

fixing means for fixing the developed image on the recording medium to which the developed image formed by said developing means has been transferred;

exhausting means for exhausting air inside of said image forming apparatus;

temperature detecting means disposed near said electrophotographic photosensitive member for detecting temperature of an interior of said image forming apparatus; and control means for controlling a number of recording media on which images are formed per unit time so as to be decreased when a temperature Ts detected by said temperature detecting means is a predetermined temperature T1 or higher and less than a temperature T2 higher than the temperature T1, and for controlling a printing operation of forming the images so as to be stopped when the temperature Ts is the temperature T2 or higher.

5. An image forming apparatus according to claim 4, wherein said temperature detecting means is disposed near an airflow path formed from said temperature detecting means to said exhausting means.

6. An image forming apparatus according to claim 4, wherein said temperature detecting means is located near a lower portion of cleaning means of said image forming apparatus.

7. An image forming apparatus according to claim 4, wherein said temperature detecting means is located above said developing means.

8. An image forming apparatus comprising:

image forming means for forming a toner image on a transfer material:

conveying means for conveying the transfer material to an image forming portion of said image forming means;

fixing means for heating and fixing the toner image on the transfer material;

a heat exhausting fan for exhausting air out of said image forming apparatus through a filter;

a temperature detecting member for detecting temperature in said image forming apparatus; and control means for controlling an interval at which transfer materials are conveyed during continuous image formation, wherein, when the temperature detected by said temperature detecting member is a predetermined temperature or higher, said control means lengthens the interval continuously or in steps until the interval reaches a predetermined value.

9. An image forming apparatus according to claim 8, further comprising stopping means for stopping an image forming operation when the temperature detected by said temperature detecting member is a stop temperature or higher, the stop temperature being higher than the predetermined temperature.

10. An image forming apparatus according to claim 8, wherein said heat exhausting fan is enabled during an image forming operation regardless of the interval.

11. An image forming apparatus according to claim 10, wherein a rotating speed of said heat exhausting fan is kept constant regardless of the interval.

12. An image forming apparatus according to claim 8, wherein said temperature detecting member is provided near said image forming means.

13. An image forming apparatus comprising:

an image bearing member;

electrostatic image forming means for forming an electrostatic image on said image bearing member;

developing means for developing the electrostatic image on said image bearing member with toner;

transfer means for transferring a toner image on said image bearing member onto a transfer material;

fixing means for heating and fixing the toner image on the transfer material;

a heat exhausting fan for exhausting air out of said image forming apparatus through a filter;

a temperature detecting member for detecting temperature in said image forming apparatus; and warning means for warning to replace the filter when the temperature detected by said temperature detecting member is a predetermined temperature or higher.

14. An image forming apparatus according to claim 13, wherein the filter is an ozone filter.

15. An image forming apparatus comprising:

image forming means for forming a toner image on a transfer material;

fixing means for heating and fixing the toner image on the transfer material;

a heat exhausting fan for exhausting air out of said image forming apparatus through a filter;

a temperature detecting member for detecting temperature in said image forming apparatus; and warning means for warning to replace the filter on the basis of the temperature detected by said temperature detecting member.

16. An image forming apparatus according to claim 15, wherein, the filter is an ozone filter.

* * * * *

UNITED STATES PATENT AND TRADEMARK OFFICE

CERTIFICATE OF CORRECTION

PATENT NO. : 6,694,108 B2
DATED : February 17, 2004
INVENTOR(S) : Hiroya Hirose et al.

It is certified that error appears in the above-identified patent and that said Letters Patent is hereby corrected as shown below:

Column 8,
Line 55, “passed” should read -- being passed --.

Column 9,
Line 34, “passed” should read -- being passed --.

Column 11,
Line 55, “the charging” should read -- said charging --.
Line 60, “near the” should read -- near said electrophotographic --.

Signed and Sealed this

Twentieth Day of July, 2004

JON W. DUDAS
*Acting Director of the United States Patent and Trademark Office*